US010084236B2

(12) United States Patent
Meng et al.

(10) Patent No.: US 10,084,236 B2
(45) Date of Patent: Sep. 25, 2018

(54) TUNABLE ANTENNA AND TERMINAL

(71) Applicant: Huawei Device (Dongguan) Co., Ltd., Dongguan (CN)

(72) Inventors: Bo Meng, Shenzhen (CN); Yi Fan, Shenzhen (CN); Wanji An, Shenzhen (CN); Hanyang Wang, Shenzhen (CN); Dongxing Tu, Shenzhen (CN); Shuhui Sun, Shenzhen (CN)

(73) Assignee: HUAWEI DEVICE (DONGGUAN) CO., LTD., Dongguan (CN)

( * ) Notice: Subject to any disclaimer, the term of this patent is extended or adjusted under 35 U.S.C. 154(b) by 0 days.

(21) Appl. No.: 15/038,132

(22) PCT Filed: Nov. 22, 2013

(86) PCT No.: PCT/CN2013/087702

§ 371 (c)(1),
(2) Date: May 20, 2016

(87) PCT Pub. No.: WO2015/074251

PCT Pub. Date: May 28, 2015

(65) Prior Publication Data

US 2016/0294060 A1 Oct. 6, 2016

(51) Int. Cl.
*H01Q 7/00* (2006.01)
*H01Q 5/328* (2015.01)
(Continued)

(52) U.S. Cl.
CPC ..... *H01Q 7/005* (2013.01); *H01Q 1/243* (2013.01); *H01Q 5/328* (2015.01); *H01Q 5/364* (2015.01); *H01Q 5/378* (2015.01); *H01Q 9/42* (2013.01)

(58) Field of Classification Search
CPC ..... H01Q 7/005; H01Q 5/328; H01Q 5/364; H01Q 5/371; H01Q 5/378; H01Q 5/385;
(Continued)

(56) References Cited

U.S. PATENT DOCUMENTS 5,095,292 A 3/1992 Masterton
5,874,926 A 2/1999 Tsuru et al.
(Continued)

FOREIGN PATENT DOCUMENTS

CN 1492538 A 4/2004
CN 102067624 A 5/2011
(Continued)

OTHER PUBLICATIONS

Partial English Translation and Abstract of Dutch Patent Application No. DE3246365, dated Nov. 7, 2016, 7 pages.
(Continued)

*Primary Examiner* — Robert Karacsony
(74) *Attorney, Agent, or Firm* — Conley Rose, P.C.

(57) ABSTRACT

The present disclosure discloses a tunable antenna and a terminal. The tunable antenna includes a circuit board, an antenna body configured to transmit and receive a signal of a first frequency band and including a feed end and a ground pin, where the feed end is disposed on the circuit board, and an electrical tuning network, where a ground point disposed on the circuit board is connected to the ground pin of the antenna body by using the electrical tuning network, and the electrical tuning network includes an inductor and a first tunable capacitor with a tunable capacitance value, where a load value of the inductor is changed by tuning a first capacitance value of the first tunable capacitor, so that a first effective electrical length of the antenna body is changed.

14 Claims, 11 Drawing Sheets

(51) Int. Cl.

| | |
|---|---|
| ***H01Q 9/42*** | (2006.01) |
| ***H01Q 1/24*** | (2006.01) |
| ***H01Q 5/364*** | (2015.01) |
| ***H01Q 5/378*** | (2015.01) |

(58) Field of Classification Search
CPC ..... H01Q 5/392; H01Q 1/243; H01Q 1/48; H01Q 9/42
See application file for complete search history.

(56) References Cited

U.S. PATENT DOCUMENTS

| | | | | |
|---|---|---|---|---|
| 6,184,833 | B1 | 2/2001 | Tran | |
| 6,297,776 | B1 | 10/2001 | Pankinaho | |
| 2004/0041733 | A1 | 3/2004 | Milosavljevic | |
| 2005/0128155 | A1 | 6/2005 | Fukuda | |
| 2006/0262028 | A1 | 11/2006 | Takei | |
| 2007/0030199 | A1 | 2/2007 | Chen | |
| 2007/0268191 | A1 | 11/2007 | Ishizuka et al. | |
| 2009/0224991 | A1 | 9/2009 | Rowson et al. | |
| 2010/0214188 | A1 | 8/2010 | Furutani et al. | |
| 2011/0032165 | A1* | 2/2011 | Heng | H01Q 7/005 343/745 |
| 2011/0063053 | A1 | 3/2011 | Guler | |
| 2011/0128200 | A1 | 6/2011 | Hossain et al. | |
| 2011/0148723 | A1 | 6/2011 | Bengtsson et al. | |
| 2012/0009983 | A1* | 1/2012 | Mow | H01Q 1/243 455/575.7 |
| 2012/0013511 | A1 | 1/2012 | Sumi et al. | |
| 2012/0050125 | A1 | 3/2012 | Leiba et al. | |
| 2012/0146865 | A1* | 6/2012 | Hayashi | H01Q 5/392 343/750 |
| 2012/0262343 | A1 | 10/2012 | Radojkovic | |
| 2014/0168028 | A1 | 6/2014 | Yanagi et al. | |

FOREIGN PATENT DOCUMENTS

| | | | |
|---|---|---|---|
| CN | 102800926 | A | 11/2012 |
| CN | 103199332 | A | 7/2013 |
| DE | 3246365 | A1 | 6/1984 |
| EP | 1542313 | A1 | 6/2005 |
| EP | 2091104 | A1 | 8/2009 |
| EP | 2328233 | A2 | 6/2011 |
| GB | 2463536 | A | 3/2010 |
| JP | 2005175902 | A | 6/2005 |
| JP | 2007194995 | A | 8/2007 |
| JP | 2011114643 | A | 6/2011 |
| JP | 2011120071 | A | 6/2011 |
| WO | 2006080141 | A1 | 8/2006 |
| WO | 2011059088 | A1 | 5/2011 |

OTHER PUBLICATIONS

Partial English Translation and Abstract of Chinese Patent Application No. CN103199332, dated May 10, 2016, 5 page.
Foreign Communication From a Counterpart Application, European Application No. 13897870.5, Extended European Search Report dated Oct. 11, 2016, 9 pages.
Foreign Communication From a Counterpart Application, PCT Application No. PCT/CN2013/087702, English Translation of International Search Report dated Aug. 27, 2014, 2 pages.
Foreign Communication From a Counterpart Application, PCT Application No. PCT/CN2013/087702, English Translation of Written Opinion dated Aug. 27, 2014, 9 pages.
Foreign Communication From a Counterpart Application, European Application No. 13897870.5, European Office Action dated Sep. 13, 2017, 8 pages.
Vlachine Translation and Abstract of Japanese Publication No. JP2007194995, Aug. 2, 2007, 17 pages.
Foreign Communication From a Counterpart Application, Japanese Application No. 2016-533159, Japanese Office Action dated May 30, 2017, 3 pages.
Foreign Communication From a Counterpart Application, Japanese Application No. 2016-533159, English Translation of Japanese Office Action dated May 30, 2017, 4 pages.
Foreign Communication From a Counterpart Application, European Application No. 13897870.5, European Office Action dated Apr. 19, 2018, 7 pages.
Foreign Communication From a Counterpart Application, Japanese Application No. 2016-533159, Japanese Office Action dated Jan. 23, 2018, 3 pages.

* cited by examiner

TUNABLE ANTENNA AND TERMINAL

CROSS-REFERENCE TO RELATED APPLICATION

This application is a U.S. National Stage of International Application No. PCT/CN2013/087702, filed on Nov. 22, 2013, which is hereby incorporated by reference in its entirety.

TECHNICAL FIELD

The present disclosure relates to the field of communications technologies, and in particular, to a tunable antenna and a terminal.

BACKGROUND

With development of 4G communication, a bandwidth range covered by a radio frequency of a personal terminal product is increasingly wider, which causes bandwidth of a terminal antenna to expand from 824-960 megahertz (MHz) and 1710-2170 MHz to 698-960 MHz & 1710-2690 MHz. For example, an E5 series is required to fully cover all frequency bands of second-generation wireless telecommunications technology (2G), third-generation wireless telecommunications technology (3G), and fourth-generation wireless telecommunications technology (4G), which brings an extreme challenge to the design of an antenna. The design of an antenna needs to break the convention.

Existing terminal devices such as a mobile phone, an E5, and a data card widely use built-in antennas that are in the form of a monopole, an Inverted-F antenna (IFA), a Planar Inverted-F antenna (PIFA), or a Loop. By relying only on radiation of the antennas, bandwidth and coverage of the antennas are limited with a given ground size and a given clearance. On a mobile phone, to resolve a problem of deficiency of low-frequency coverage and high-frequency bandwidth, some antennas featuring tunability are usually designed based on the form of the antennas. In most cases, a solution in which a switch is used together with a variable capacitor or inductor is adopted to achieve a purpose of frequency tuning. For example, a different inductance or capacitance value selected by a switch at a stub of an antenna represents a different load of the antenna, that is, represents a different equivalent electrical length that determines a resonance point of the antenna, as well as a different operating frequency band of the antenna. In a matching position, a different capacitor or inductor is selected by the switch, which leads to a change of antenna matching and a change of the bandwidth and the operating frequency band of the antenna. In this way, an operating state of the antenna is changed by using a switch such that the antenna operates on different frequency bands, thereby achieving a purpose of frequency switching (or tuning).

In the prior art, the purpose of frequency tuning is achieved by using different capacitors or inductors selected by a switch. When frequency tuning is performed by using a capacitor or an inductor, a tunable frequency band range is relatively narrow. Further, because only several capacitors or inductors are generally selected by the switch, frequency bands obtained in such a tuning manner are discontinuous.

Further, a solution with a switch-gated capacitor or inductor in the prior art is generally applied to a mobile phone. However, because different terminals are in different forms, the solution with a switch-gated capacitor or inductor that is applicable to tuning of a mobile phone is not applicable to other terminals. Using a Wide-Area Network (WAN) card as an example, a mobile phone and a WAN card have different ground lengths, and the ground length of the former is longer than the ground length of the latter by more than 50 millimeters. Therefore, when the solution with a switch-gated capacitor or inductor that is applicable to a mobile phone is applied to a WAN card, a shorter ground length of the WAN card deteriorates low-frequency performance of the antenna.

Further, when the solution with a switch-gated capacitor or inductor is used for frequency tuning, an insertion loss of the switch is great, and impedance between the switch and the tunable antenna is prone to mismatch.

SUMMARY

Embodiments of the present disclosure provide a tunable antenna and a terminal in order to resolve a technical problem in the prior art that a tunable frequency band range is relatively narrow when a tunable antenna is tuned.

According to a first aspect of this application, a tunable antenna is provided, including a circuit board, an antenna body, configured to transmit and receive a signal of a first frequency band and including a feed end and a ground pin, where the feed end is disposed on the circuit board, and an electrical tuning network, where a ground point disposed on the circuit board is connected to the ground pin of the antenna body by using the electrical tuning network, and the electrical tuning network includes an inductor and a first tunable capacitor with a tunable capacitance value, where a load value of the inductor is changed by tuning a first capacitance value of the first tunable capacitor so that a first effective electrical length of the antenna body is changed.

With reference to the first aspect, in a first possible implementation manner, the inductor is connected in series to the first tunable capacitor, and then the load value is reduced by using the first tunable capacitor so that the first effective electrical length is reduced.

With reference to the first aspect, in a second possible implementation manner, the inductor is connected in parallel to the first tunable capacitor, and then the load value is increased by using the first tunable capacitor so that the first effective electrical length is increased.

With reference to the first aspect, in a third possible implementation manner, the first tunable capacitor includes a first tunable sub-capacitor and a second tunable sub-capacitor, where the first tunable sub-capacitor is connected in series to the inductor, and the second tunable sub-capacitor is connected in parallel to the inductor and the first tunable sub-capacitor, where when the first tunable sub-capacitor operates properly and the second tunable sub-capacitor is open-circuited, the load value is reduced by using the first tunable sub-capacitor so that the first effective electrical length is reduced, when the first tunable sub-capacitor is short-circuited and the second tunable sub-capacitor operates properly, the load value is increased by using the second tunable sub-capacitor so that the first effective electrical length is increased.

With reference to the first aspect or any possible implementation manner of the first to the third possible implementation manners of the first aspect, in a fourth possible implementation manner, that the electrical tuning network is connected to the ground pin on the antenna body is that the electrical tuning network is connected to a tail end of the ground pin or connected to an area that is on the antenna body and near the ground pin.

With reference to the first aspect or any possible implementation manner of the first to the fourth possible implementation manners of the first aspect, in a fifth possible implementation manner, the tunable antenna further includes a parasitic antenna stub, disposed on the circuit board and configured to excite a high-frequency mode of the first frequency band.

With reference to the first aspect, in a sixth possible implementation manner, the antenna body is disposed at an edge of the circuit board.

With reference to the fifth possible implementation manner of the first aspect, in a seventh possible implementation manner, the parasitic antenna stub is disposed at an edge of the circuit board and near the feed end.

With reference to the fifth possible implementation manner of the first aspect, in an eighth possible implementation manner, the tunable antenna further includes a second tunable capacitor, disposed at a tail end of the parasitic antenna stub, where the first effective electrical length and a second effective electrical length of the parasitic antenna stub are changed by tuning a second capacitance value of the second tunable capacitor.

According to a second aspect of this application, a terminal is provided, including a tunable antenna and a processor, where the tunable antenna includes a circuit board, an antenna body, configured to transmit and receive a signal of a first frequency band and including a feed end and a ground pin, where the feed end is disposed on the circuit board, and an electrical tuning network, where a ground point disposed on the circuit board is connected to the ground pin of the antenna body by using the electrical tuning network, and the electrical tuning network includes an inductor and a first tunable capacitor with a tunable capacitance value, where a load value of the inductor is changed by tuning a first capacitance value of the first tunable capacitor so that a first effective electrical length of the antenna body is changed, where the processor is configured to process transmitted and received signals of the tunable antenna.

With reference to the second aspect, in a first possible implementation manner, the inductor is connected in series to the first tunable capacitor, and then the load value is reduced by using the first tunable capacitor so that the first effective electrical length is reduced.

With reference to the second aspect, in a second possible implementation manner, the inductor is connected in parallel to the first tunable capacitor, and then the load value is increased by using the first tunable capacitor so that the first effective electrical length is increased.

With reference to the second aspect, in a third possible implementation manner, the first tunable capacitor includes a first tunable sub-capacitor and a second tunable sub-capacitor, where the first tunable sub-capacitor is connected in series to the inductor, and the second tunable sub-capacitor is connected in parallel to the inductor and the first tunable sub-capacitor, where when the first tunable sub-capacitor operates properly and the second tunable sub-capacitor is open-circuited, the load value is reduced by using the first tunable sub-capacitor so that the first effective electrical length is reduced, when the first tunable sub-capacitor is short-circuited and the second tunable sub-capacitor operates properly, the load value is increased by using the second tunable sub-capacitor so that the first effective electrical length is increased.

With reference to the second aspect or the first to the third possible implementation manners of the second aspect, in a fourth possible implementation manner, that the electrical tuning network is connected to the ground pin on the antenna body is that the electrical tuning network is connected to a tail end of the ground pin or connected to an area that is on the antenna body and near the ground pin.

With reference to the second aspect or the first to the fourth possible implementation manners of the second aspect, in a fifth possible implementation manner, the tunable antenna further includes a parasitic antenna stub, disposed on the circuit board and configured to excite a high-frequency mode of the first frequency band.

With reference to the second aspect, in a sixth possible implementation manner, the antenna body is disposed at an edge of the circuit board.

With reference to the fifth possible implementation manner of the second aspect, in a seventh possible implementation manner, the parasitic antenna stub is disposed at an edge of the circuit board and near the feed end.

With reference to the fifth possible implementation manner of the second aspect, in an eighth possible implementation manner, the tunable antenna further includes a second tunable capacitor, disposed at a tail end of the parasitic antenna stub, where the first effective electrical length and a second effective electrical length of the parasitic antenna stub are changed by tuning a second capacitance value of the second tunable capacitor.

Beneficial effects of the present disclosure are as follows:

In the embodiments of the present disclosure, a tunable antenna is provided. The tunable antenna includes an antenna body and an electrical tuning network. A first effective electrical length of the antenna body can be tuned by using the electrical tuning network. By tuning the first effective electrical length, a frequency band range of the tunable antenna is changed. The electrical tuning network includes an inductor and a first tunable capacitor with a tunable capacitance value. A load value of the inductor can be changed by tuning the first tunable capacitor so that the first effective electrical length is changed. Because frequency tuning can be performed by using the inductor together with the first tunable capacitor, a frequency band range that can be tuned by means of frequency tuning is increased.

Further, because a range of a first capacitance value of the first tunable capacitor is continuous, a frequency band obtained when the frequency band range of the tunable antenna is tuned in such a tuning manner is also continuous, and the obtained frequency band range is relatively wide.

Further, because the load value of the inductor is tuned by using the first tunable capacitor, the load value of the inductor can be tuned in a relatively wide range, and therefore the first effective electrical length can also be adjusted in a relatively wide range. That is, in contrast with the prior art, even if a length of the antenna body is less than a length of the antenna body in the prior art, the first electrical length of the tunable antenna can still reach an electrical length of the antenna in the prior art by using the first tunable capacitor together with the inductor. Therefore, in a same frequency band range, the tunable antenna in the embodiments of the present disclosure has a relatively small size.

Further, even if a tunable antenna applied to a mobile phone in the prior art is applied to a WAN card, an effective electrical length of an antenna of the WAN card is not reduced such that relatively good low-frequency performance is ensured.

Further, when frequency tuning is performed by using the first tunable capacitor and the inductor, an insertion loss is relatively low. In addition, compared with a switch, ports of the first tunable capacitor and the inductor better match impedance of the tunable antenna.

DESCRIPTION OF EMBODIMENTS

Figure 1A:
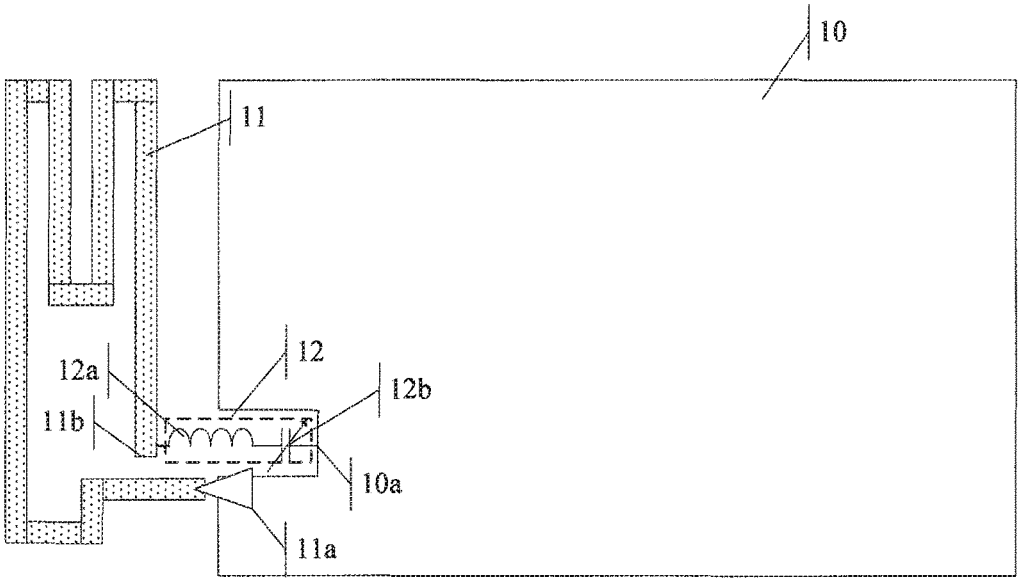
FIG. 1A is a structural diagram of a tunable antenna in which an inductor of an electrical tuning network is connected in series to a first tunable capacitor of the electrical tuning network according to an embodiment of the present disclosure.

To resolve a technical problem in the prior art that a tunable frequency band range is relatively narrow when a tunable antenna is tuned, embodiments of the present disclosure provide a tunable antenna and a terminal. The tunable antenna includes a circuit board, an antenna body, and an electrical tuning network. A first effective electrical length of the antenna body can be tuned by using the electrical tuning network. By tuning the first effective electrical length, a frequency band range of the tunable antenna is changed. The electrical tuning network may include an inductor and a first tunable capacitor with a tunable capacitance value. A load value of the inductor can be changed by tuning the first tunable capacitor so that the first effective electrical length is changed. Because frequency tuning can be performed by using the inductor together with the first tunable capacitor, a frequency band range that can be tuned by means of frequency tuning is increased.

Further, because a range of a first capacitance value of the first tunable capacitor is continuous, a frequency band obtained when the frequency band range of the tunable antenna is tuned in such a tuning manner is also continuous, and the obtained frequency band range is relatively wide.

Further, because the load value of the inductor is tuned by using the first tunable capacitor, the load value of the inductor can be tuned in a relatively wide range, and therefore the first effective electrical length can also be adjusted in a relatively wide range. That is, in contrast with the prior art, even if a length of the antenna body is less than a length of the antenna body in the prior art, the first electrical length of the tunable antenna can still reach an electrical length of the antenna in the prior art by using the first tunable capacitor together with the inductor. Therefore, in a same frequency band range, the tunable antenna in the embodiments of the present disclosure has a relatively small size.

Further, even if a tunable antenna applied to a mobile phone in the prior art is applied to a WAN card, an effective electrical length of an antenna of the WAN card is not reduced such that relatively good low-frequency performance is ensured.

Further, when frequency tuning is performed by using the first tunable capacitor and the inductor, an insertion loss is relatively low. In addition, compared with a switch, ports of the first tunable capacitor and the inductor better match impedance of the tunable antenna.

To make the objectives, technical solutions, and advantages of the embodiments of the present disclosure clearer, the following clearly and completely describes the technical solutions in the embodiments of the present disclosure with reference to the accompanying drawings in the embodiments of the present disclosure. Apparently, the described embodiments are a part rather than all of the embodiments of the present disclosure. All other embodiments obtained without creative efforts by persons of ordinary skill in the art based on the embodiments of the present disclosure shall fall within the protection scope of the present disclosure.

According to a first aspect, an embodiment of the present disclosure provides a tunable antenna. The tunable antenna is, for example, a Loop antenna, an IFA antenna, a Monopole antenna, or the like.

Figure 1B:
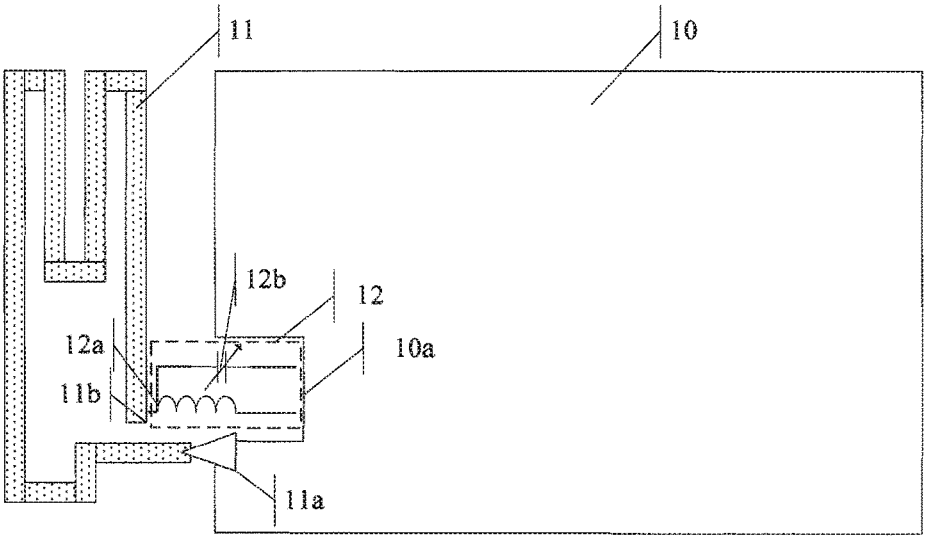
FIG. 1B is a structural diagram of a tunable antenna in which an inductor of an electrical tuning network is connected in parallel to a first tunable capacitor of the electrical tuning network according to an embodiment of the present disclosure.
Figure 1C:
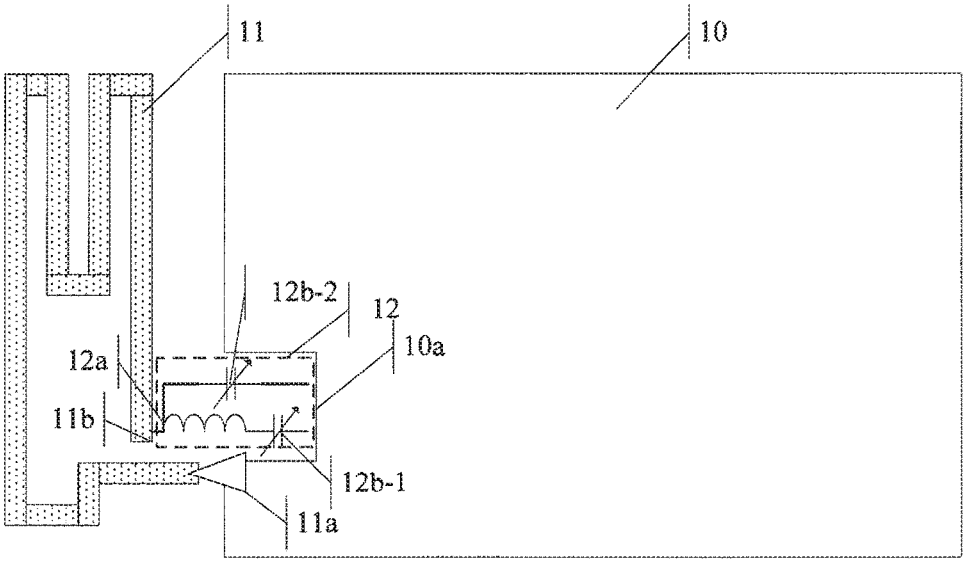
FIG. 1C is a structural diagram of a tunable antenna in which an inductor of an electrical tuning network is connected in series to a first tunable capacitor of the electrical tuning network according to an embodiment of the present disclosure.

Referring to FIG. 1A to FIG. 1C, the tunable antenna includes the following structure a circuit board 10, where the circuit board 10 is used as a reference ground of the tunable antenna, and a size of the circuit board 10 may be set according to a requirement, for example, 65×52 millimeter (mm), an antenna body 11, configured to transmit and receive a signal of a first frequency band and including a feed end 11*a* and a ground pin 11*b*, where the feed end 11*a* is disposed on the circuit board 10, and the ground pin 11*b* refers to another end that is different from the feed end 11*a* on the antenna body 11, the first frequency band may include both a high-frequency band and a low-frequency band, the low-frequency band is, for example, 791-960 MHz, 696-984 MHz, or 704-960 MHz, and the high-frequency band is, for example, 1710-2690 MHz, or the like, which is not limited in this embodiment of the present disclosure, and an electrical tuning network 12, where a ground point 10*a* disposed on the circuit board 10 is connected to the ground pin 11*b* of the antenna body 11 by using the electrical tuning network 12, and the electrical tuning network 12 includes an inductor 12*a* and a first tunable capacitor 12*b* with a tunable capacitance value, where a load value of the inductor 12*a* is changed by tuning a first capacitance value of the first tunable capacitor 12*b* so that a first effective electrical length of the antenna body 11 is changed.

In a specific implementation process, an inductance value of the inductor 12*a* may be any value such as 20 inductance (nH), 30 nH, and 33 nH, which is not limited in this embodiment of the present disclosure.

In a further preferred embodiment, the inductance value of the inductor 12*a* is greater than a first preset inductance value. The first preset inductance value is, for example, 8 nH, 10 nH, and 15 nH, which is not limited in this embodiment of the present disclosure. The first preset inductance value generally depends on a ground length of the reference ground and a clearance of the antenna. A greater ground length and clearance of the antenna indicates a smaller corresponding first preset inductance value. For example, if the tunable antenna is applied to a mobile phone, the first preset inductance value may be 8 nH, if the tunable antenna is applied to a WAN card, the first preset inductance value may be 15 nH. In this case, the inductor 12*a* causes a current value in a high-frequency mode of the tunable antenna to be 0 at the inductor 12*a*, which exerts a choke effect on a high-frequency signal and exerts a cutoff function to a high-frequency radiation mode in the tunable antenna such that the high-frequency signal is not affected by the electrical tuning network 12. That is, the low-frequency mode and the high-frequency mode of the tunable antenna may exist independently, and the high-frequency mode is not affected by low-frequency tuning.

Further, the inductance value of the inductor 12*a* is less than a second preset inductance value. The second preset inductance value may also vary, such as 47 nH, 45 nH, and 40 nH, which is not limited in this embodiment of the present disclosure. In this case, sharp deterioration of low-frequency performance of the tunable antenna can be avoided.

In a specific implementation process, a maximum value of the first tunable capacitor 12*b* may also be any value, such as 1 picofarads (pF), 2 pF, and 4 pF. The first tunable capacitor 12*b* may be any value that is not more than the maximum value. Based on different step sizes of the first tunable capacitor 12*b*, an exact value of tuning for the first tunable capacitor 12*b* differs. The step size of the first tunable capacitor 12*b* is, for example, 0.1 pF or 0.2 pF, which is not limited in this embodiment of the present disclosure.

In a specific implementation process, the electrical tuning network 12 may have multiple structures, three of which are described below as examples. The structures are not limited to the following three cases.

A first type of structure is referring to FIG. 1A, the electrical tuning network 12 includes an inductor 12*a* and a first tunable capacitor 12*b*, where the inductor 12*a* is connected in series to the first tunable capacitor 12*b*. In this way, a load value of the inductor 12*a* is reduced by using the first tunable capacitor 12*b* so that a first effective electrical length is reduced.

In a specific implementation process, loading the inductor 12*a* on a side of the ground pin 11*b* of the antenna body 11 is equivalent to increasing the first effective electrical length. In this case, a low-frequency resonance point of the tunable antenna moves downward. However, if the inductor 12*a* is connected in series to the first tunable capacitor 12*b*, it is equivalent that the load value of the inductor 12*a* is reduced. A higher first capacitance value indicates a greater decrease in the load value of the inductor 12*a*. As a result, the first effective electrical length is reduced on the basis of the inductor 12*a*. In this case, the low-frequency resonance point of the tunable antenna moves upward. Therefore, a purpose of low-frequency tuning of the tunable antenna can be achieved by selecting an inductor 12*a* and a first tunable capacitor 12*b* of proper values.

For a second structure, refer to FIG. 1B. The electrical tuning network 12 includes an inductor 12*a* and a first tunable capacitor 12*b*, where the inductor 12*a* is connected in parallel to the first tunable capacitor 12*b*. In this way, a load value of the inductor 12*a* is increased by using the first tunable capacitor 12*b* so that a first effective electrical length is increased.

In a specific implementation process, if the inductor 12*a* is connected in parallel to the first tunable capacitor 12*b*, it is equivalent that the load value of the inductor 12*a* is increased. A higher first capacitance value indicates a higher load value of the inductor 12*a*. In this case, the first effective electrical length is further increased on the basis of the inductor 12*a*. In this way, the low-frequency resonance point of the tunable antenna still moves downward such that a tunable range of a low frequency of the tunable antenna is further decreased.

For a third structure, refer to FIG. 1*c*. The electrical tuning network 12 includes an inductor 12*a* and a first tunable capacitor 12*b*, where the first tunable capacitor 12*b* includes a first tunable sub-capacitor 12*b*-1 and a second tunable sub-capacitor 12*b*-2, the first tunable sub-capacitor 12*b*-1 is connected in series to the inductor 12*a*, and the second tunable sub-capacitor 12*b*-2 is connected in parallel to the inductor 12*a* and the first tunable sub-capacitor 12*b*-1. When the first tunable sub-capacitor 12*b*-1 operates properly and the second tunable sub-capacitor 12*b*-2 is open-circuited, the load value is reduced by using the first tunable sub-capacitor 12*b*-1 so that the first effective electrical length is reduced, when the first tunable sub-capacitor 12*b*-1 is short-circuited and the second tunable sub-capacitor 12*b*-2 operates properly, the load value is increased by using the second tunable sub-capacitor 12*b*-2 so that the first effective electrical length is increased.

In a specific implementation process, when the first tunable sub-capacitor 12*b*-1 operates properly and the second tunable sub-capacitor 12*b*-2 is open-circuited, which is equivalent to that the second tunable sub-capacitor 12*b*-2 does not exist and also equivalent to that the first tunable sub-capacitor 12*b*-1 is connected in series to the inductor 12*a* in the electrical tuning network 12. In this case, the first tunable sub-capacitor 12*b*-1 reduces the load value of the inductor 12*a*, and further, the first effective electrical length is reduced on the basis of the inductor 12*a*. In this way, the low-frequency resonance point of the tunable antenna moves upward on the basis of the inductor 12*a*. A higher tuned capacitance value of the first tunable sub-capacitor 12*b*-1 indicates a longer distance by which the low-frequency resonance point moves upward. When the first tunable sub-capacitor 12*b*-1 is short-circuited and the second tunable sub-capacitor 12*b*-2 operates properly, which is equivalent to that the first tunable sub-capacitor 12*b*-1 does not exist and also equivalent to that the second tunable sub-capacitor 12*b*-2 is connected in parallel to the inductor 12*a* in the electrical tuning network 12. In this case, the second tunable sub-capacitor 12*b*-2 increases the load value of the inductor 12*a*, and further, the first effective electrical length is increased on the basis of the inductor 12*a*. In this way, the low-frequency resonance point of the tunable antenna moves downward on the basis of the inductor 12*a*.

That is, in a case in which the electrical tuning network 12 includes both a first tunable sub-capacitor 12*b*-1 and a second tunable sub-capacitor 12*b*-2, the low-frequency resonance point of the tunable antenna can move downward and the low-frequency resonance point of the tunable antenna can also move upward on the basis of the inductor 12*a*, which further increases tunable bandwidth of a low frequency of the tunable wire.

Further, to ensure good performance of a high-frequency signal of the tunable antenna, the second tunable sub-capacitor 12*b*-2 is less than a capacitance threshold, where the capacitance threshold is, for example, 2 pF, or may be another value such as 1.9 pF or 2.1 pF, which is not limited in this embodiment of the present disclosure. In a specific implementation process, a higher capacitance value of the second tunable sub-capacitor 12*b*-2 indicates higher sensitivity of the resonance point of the high-frequency signal, which leads to mismatch between the second tunable sub-capacitor 12*b*-2 and the tunable antenna. Therefore, to prevent deterioration of high-frequency performance of the tunable antenna, it needs to be ensured that the capacitance value of the second tunable sub-capacitor 12*b*-2 is less than the capacitance threshold.

In a specific implementation process, when the electrical tuning network 12 is connected to the ground pin 11*b* of the antenna body 11, the electrical tuning network 12 may be connected to multiple positions, for example, connected to a tail end of the ground pin 11*b*, or connected to an area that is on the antenna body 11 and near the ground pin 11*b*, which is not limited in this embodiment of the present disclosure.

In a further preferred embodiment, the electrical tuning network 12 is connected to the tail end of the ground pin 11*b*.

That is, the ground pin 11*b* is connected to the electrical tuning network 12, and then the ground pin 11*b* is connected to a ground point 10*a* by using the electrical tuning network 12. In this case, the electrical tuning network 12 can achieve a better tuning effect.

Figure 2:
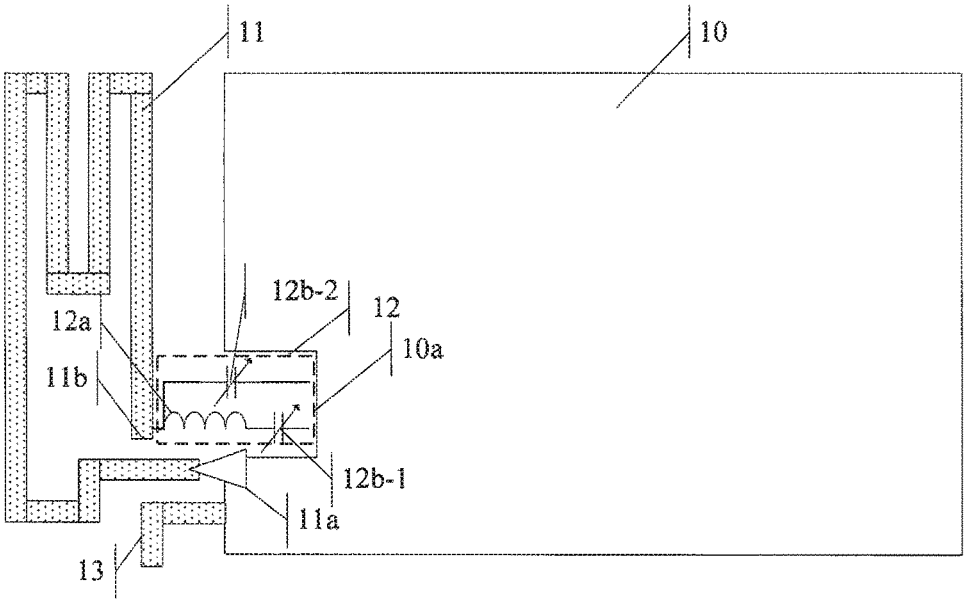
FIG. 2 is a structural diagram of a tunable antenna that includes a parasitic antenna stub according to an embodiment of the present disclosure.

In a further preferred embodiment, referring to FIG. 2, the tunable antenna further includes a parasitic antenna stub 13, disposed on the circuit board 10 and configured to excite a high-frequency mode of the first frequency band. When the antenna body 11 receives a high-frequency signal, the high-frequency mode is excited by using the parasitic antenna stub 13, energy of the parasitic antenna stub 13 can be coupled with a part of energy of the antenna body 11 and radiated, thereby improving high-frequency performance.

In a further preferred embodiment, the antenna body 11 is disposed at an edge of the circuit board 10. Because a current at the edge of the circuit board 10 is stronger than a current at a center, a path through which a low-frequency current flows is relatively long in this case, which further helps improve low-frequency performance.

In a specific implementation process, the parasitic antenna stub 13 may be disposed in any position of the circuit board 10, for example, disposed at the edge of the circuit board 10 and on a side that is near the ground pin 11*b* and away from the feed end 11*a*, or disposed at the edge of the circuit board 10 and on a side that is near the feed end 11*a*, which is not limited in this embodiment of the present disclosure.

In a further preferred embodiment, still referring to FIG. 2, the parasitic antenna stub 13 is disposed at the edge of the circuit board 10 and near the feed end 11*a*. In this case, because the parasitic antenna stub 13 is near the feed end 11*a*, a coupling effect is relatively good, radiation of the parasitic antenna stub 13 can be ensured, and high-frequency transmitting and receiving performance of the tunable antenna is further improved.

Figure 3:
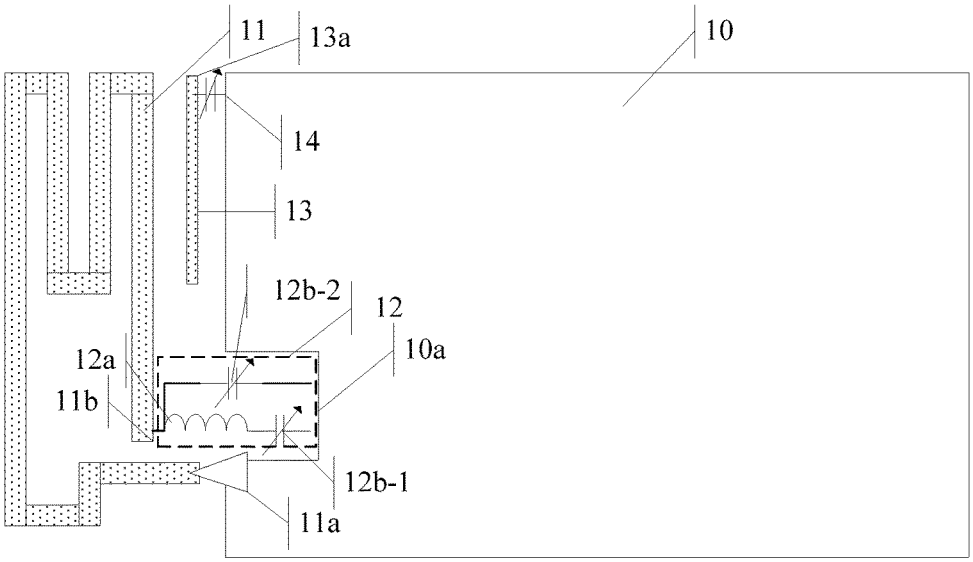
FIG. 3 is a structural diagram of a tunable antenna that includes a second tunable capacitor according to an embodiment of the present disclosure.

In a further preferred embodiment, referring to FIG. 3, the tunable antenna further includes a second tunable capacitor 14, disposed at a tail end 13*a* of the parasitic antenna stub 13, where the first effective electrical length and a second effective electrical length of the parasitic antenna stub 13 are changed by tuning a second capacitance value of the second tunable capacitor 14.

In a specific implementation process, the second tunable capacitor 14 is connected in series to the parasitic antenna stub 13, and is mainly configured to reduce the second effective electrical length, causing a resonance point of the tunable antenna to move upward, and in addition, slightly reduce the first effective electrical length, causing a low-frequency resonance point of the tunable antenna to move upward.

The following uses several specific embodiments to describe a tunable antenna in the present disclosure. The following embodiments mainly describe several possible implementation structures of the tunable antenna. It should be noted that the embodiments in the present disclosure are used only for interpreting the present disclosure rather than limiting the present disclosure. All embodiments compliant with ideas of the present disclosure shall fall within the protection scope of the present disclosure. Persons skilled in the art naturally learn how to make variations according to the ideas of the present disclosure.

Embodiment 1

Figure 4:
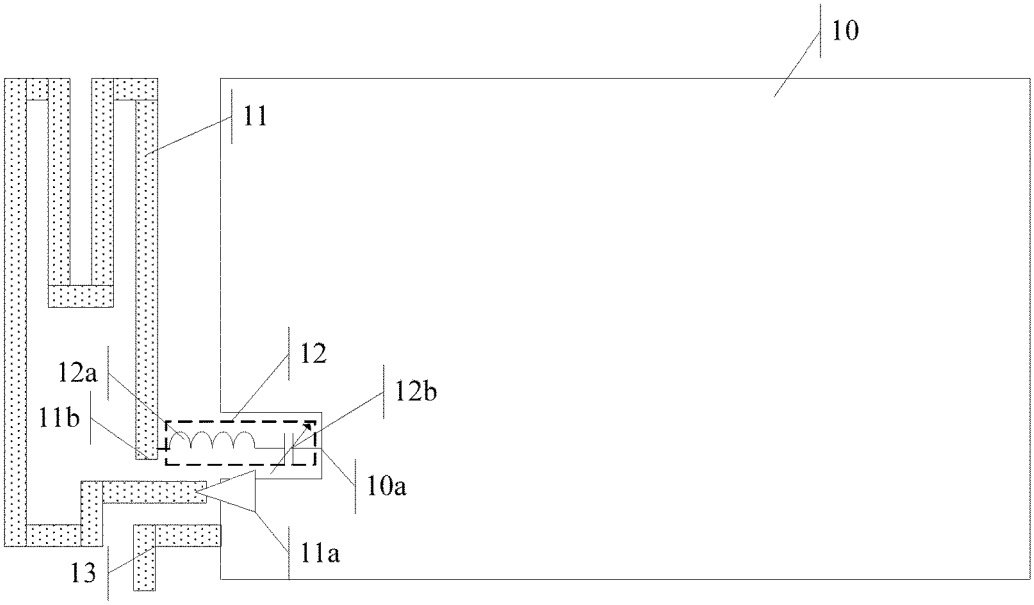
FIG. 4 is a structural diagram of a tunable antenna according to Embodiment 1 of the present disclosure.

This embodiment provides a tunable antenna. Referring to FIG. 4, the tunable antenna includes the following structure a circuit board 10 that is 65×52 mm in size, an antenna body 11 that includes a feed end 11*a* and a ground pin 11*b*, where the feed end 11*a* is disposed at an edge of the circuit board 10, an electrical tuning network 12, where a ground point 10*a* disposed on the circuit board 10 is connected to the ground pin 11*b* of the antenna body 11 by using the electrical tuning network 12, and the electrical tuning network 12 includes an inductor 12*a* and a first tunable capacitor 12*b* connected in series to the inductor 12*a*, a first electrical length of the antenna body 11 can be extended by using the inductor 12*a*, and the first tunable capacitor 12*b* reduces the first electrical length on the basis of the inductor 12*a*, where an inductance value of the inductor 12*a* is 33 nH, and a value range of the first tunable capacitor 12*b* is 0-8 pF, and a parasitic antenna stub 13, disposed at the edge of the circuit board 10 and on a side that is near the feed end 11*a*, and configured to excite a high-frequency mode.

Figure 5A:
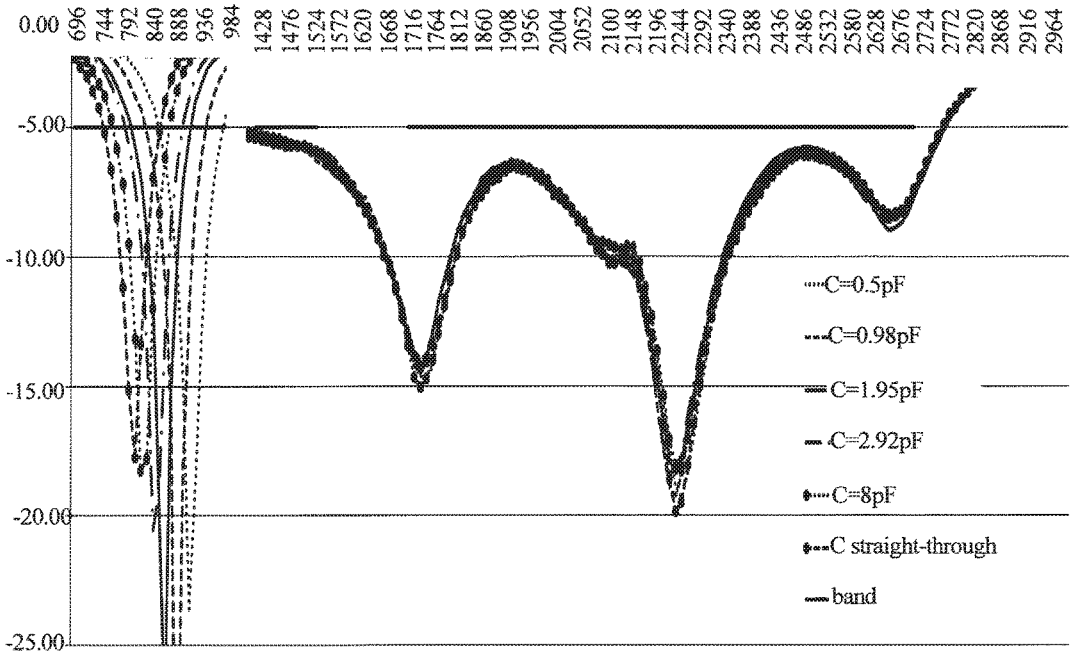
FIG. 5A is a schematic diagram of bandwidth and return losses of a tunable antenna when a first tunable capacitor is set to different values according to Embodiment 1 of the present disclosure.
Figure 5B:
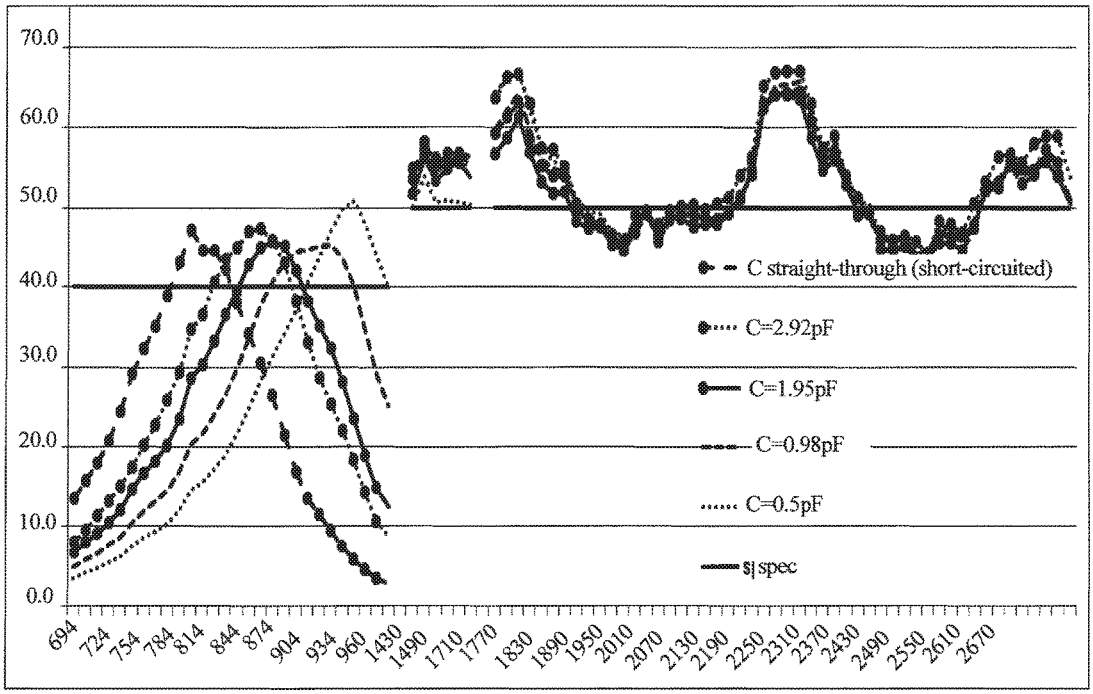
FIG. 5B is a schematic diagram of bandwidth and efficiency of a tunable antenna when a first tunable capacitor is set to different values according to Embodiment 1 of the present disclosure.

As shown in FIG. 5A, which is a schematic diagram of bandwidth and return losses of the tunable antenna when the first tunable capacitor 12*b* is set to different values, and FIG. 5B is a schematic diagram of bandwidth and efficiency of the tunable antenna when the first tunable capacitor 12*b* is set to different values. Generally, to ensure normal transmitting and receiving of the tunable antenna, it needs to be ensured that the return loss is less than −5 decibel (dB), low-frequency efficiency is higher than 40%, and high-frequency efficiency is higher than 50%. It can be seen from FIG. 5A and FIG. 5B that bandwidth of the tunable antenna with a return loss being less than −5 dB, low-frequency efficiency being higher than 40%, and high-frequency efficiency being higher than 50% covers 791-960 MHz, 1420-1520 MHz, and 1710-2690 MHz, which can cover Long Term Evolution (LTE), Frequency Division Duplex (FDD) and Time Division Duplex (TDD) frequency bands in Europe and frequency bands required in Japan.

Embodiment 2

This embodiment provides a tunable antenna. Referring to FIG. 2, the tunable antenna includes a circuit board 10 that is 65×52 mm in size, an antenna body 11, configured to transmit and receive a signal of a first frequency band and including a feed end 11*a* and a ground pin 11*b*, where the feed end 11*a* is disposed on the circuit board 10, and the first frequency band generally includes both a high-frequency band and a low-frequency band, an electrical tuning network 12, where a ground point 10*a* disposed on the circuit board 10 is connected to the ground pin of the antenna body 11 by using the electrical tuning network 12, and the electrical tuning network 12 includes an inductor 12*a*, a first tunable sub-capacitor 12*b*-1 connected in series to the inductor 12*a*, and a second tunable sub-capacitor 12*b*-2 connected in parallel to the inductor 12*a*, and a parasitic antenna stub 13, disposed at the edge of the circuit board 10 and on a side that is near the feed end 11*a*.

First, the first tunable capacitor 12*b*-1 is tuned to a short-circuited state, and the second tunable capacitor 12*b*-2 is tuned to 0.3 pF. In this case, a low-frequency resonance point may be tuned to near 720 MHz, the first tunable sub-capacitor 12*b*-1 is kept in the short-circuited state, and a value of the second tunable sub-capacitor 12*b*-2 is increased such that the low-frequency resonance point of the tunable antenna can be controlled to further move downward.

Figure 6A:
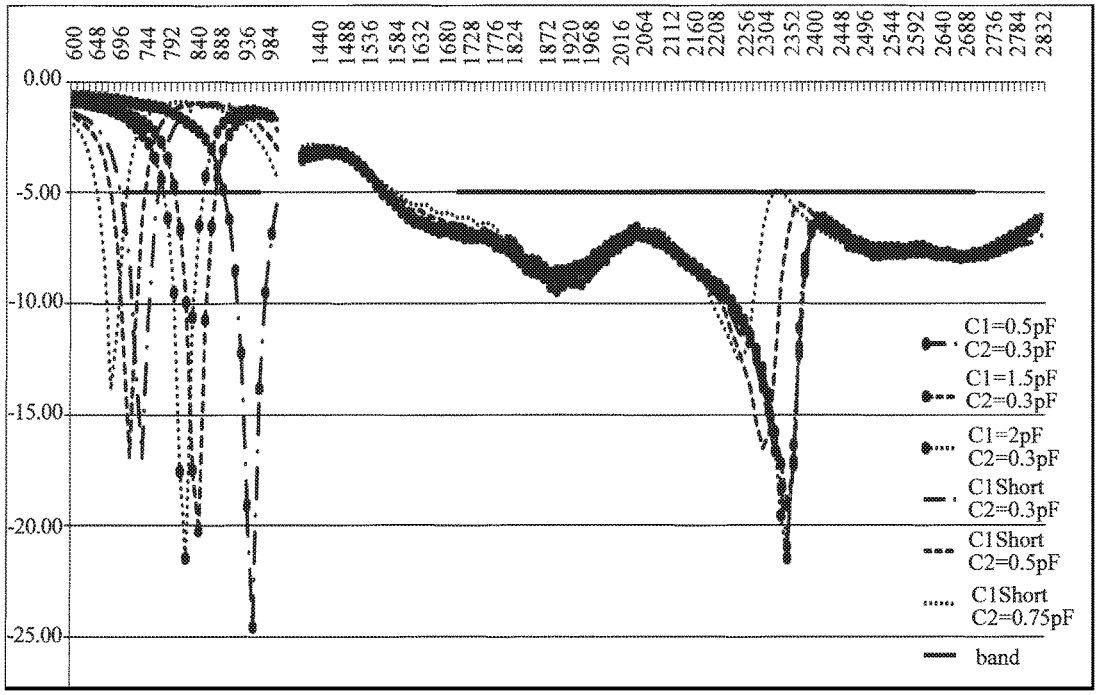
FIG. 6A is a schematic diagram of bandwidth and return losses of a tunable antenna when a first tunable sub-capacitor and a second tunable sub-capacitor are set to different values according to Embodiment 2 of the present disclosure.
Figure 6B:
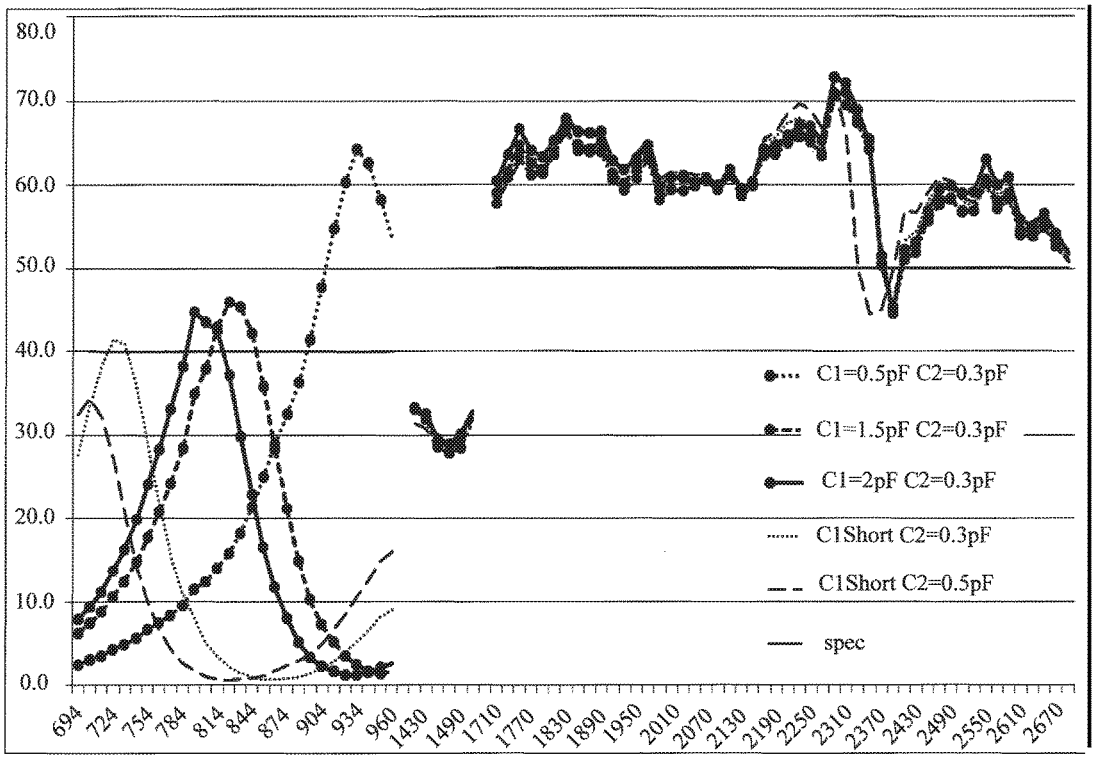
FIG. 6B is a schematic diagram of bandwidth and efficiency of a tunable antenna when a first tunable sub-capacitor and a second tunable sub-capacitor are set to different values according to Embodiment 2 of the present disclosure.

FIG. 6A is a schematic diagram of bandwidth and return losses of the tunable antenna when the first tunable sub-capacitor 12*b*-1 and the second tunable sub-capacitor 12*b*-2 are set to different values, and FIG. 6B is a schematic diagram of bandwidth and efficiency of the tunable antenna when the first tunable sub-capacitor 12*b*-1 and the second tunable sub-capacitor 12*b*-2 are set to different values. It can be learned from an emulation result of FIG. 6A and FIG. 6B that when a return loss is less than −5 dB, low-frequency efficiency is higher than 40%, and high-frequency efficiency is higher than 50%, bandwidth of the tunable antenna satisfies 698-960 MHz and 1710-2690 MHz, which can cover European LTE, FDD and TDD frequency bands and North American frequency bands.

Embodiment 3

Figure 7:
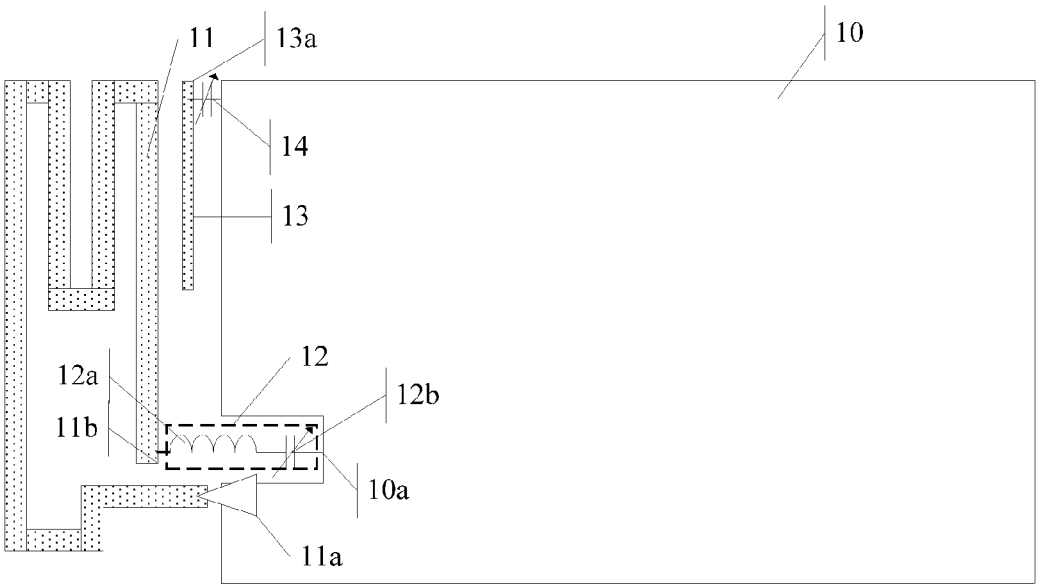
FIG. 7 is a structural diagram of a tunable antenna according to Embodiment 3 of the present disclosure.

This embodiment provides a tunable antenna. Referring to FIG. 7, the antenna includes the following structure a circuit board 10 that is 65×52 mm in size, an antenna body 11, configured to transmit and receive a signal of a low-frequency band and including a feed end 11*a* and a ground pin 11*b*, where the feed end 11*a* is disposed at an edge of the circuit board 10, an electrical tuning network 12, where a ground point 10*a* disposed on the circuit board 10 is connected to the ground pin 11*b* of the antenna body 11 by using the electrical tuning network 12, and the electrical tuning network 12 includes an inductor 12*a* and a first tunable capacitor 12*b* connected in series to the inductor 12*a*, a first electrical length of the antenna body 11 can be extended by using the inductor 12*a*, and the first tunable capacitor 12*b* reduces the first electrical length on the basis of the inductor 12*a*, where an inductance value of the inductor 12*a* is 33 nH, and a value range of the first tunable capacitor 12*b* is 0-8 pF, a parasitic antenna stub 13, disposed at the edge of the circuit board 10 and on a side that is near the ground pin 11*b* and away from the feed end 11*a*, and a second tunable capacitor 14, disposed at a tail end 13*a* of the parasitic antenna stub 13.

Figure 8A:
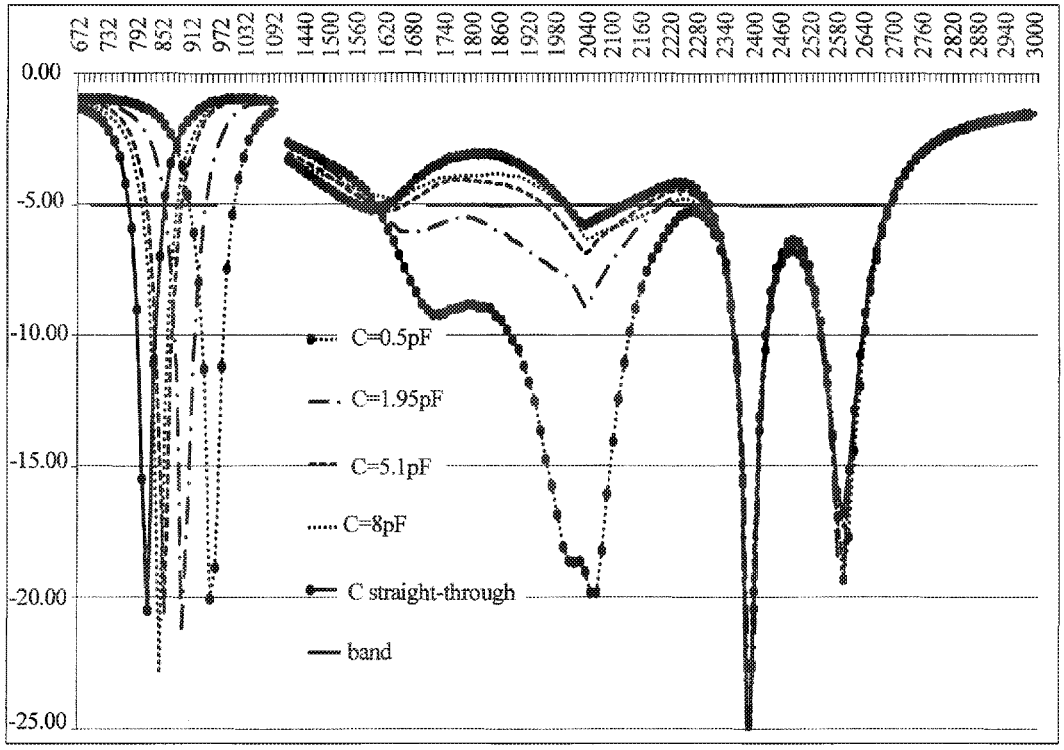
FIG. 8A is a schematic diagram of bandwidth and return losses of a tunable antenna when a first tunable capacitor is set to different values according to Embodiment 3 of the present disclosure.
Figure 8B:
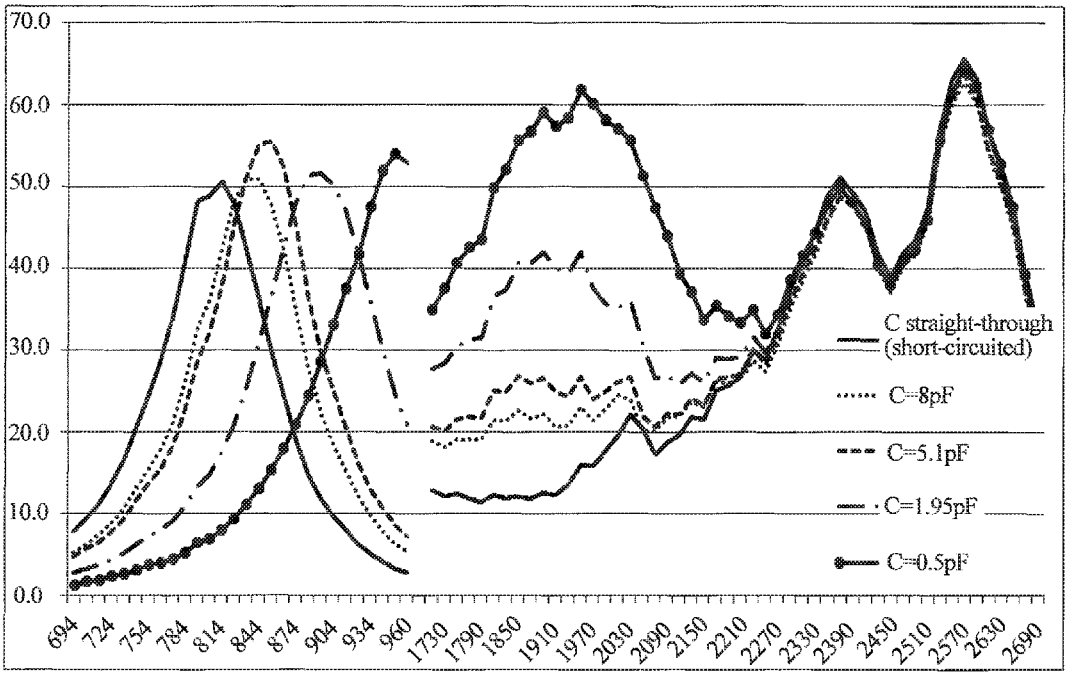
FIG. 8B is a schematic diagram of bandwidth and efficiency of a tunable antenna when a first tunable capacitor is set to different values according to Embodiment 3 of the present disclosure.

As shown in FIG. 8A, which is a schematic diagram of bandwidth and return losses of the tunable antenna when the first tunable capacitor 12*b* is set to different values, and FIG. 8B is a schematic diagram of bandwidth and efficiency of the tunable antenna when the first tunable capacitor 12*b* is set to different values.

According to a second aspect, an embodiment of the present disclosure provides a terminal, where the terminal is, for example, a mobile phone, a tablet, or a WAN card.

Figure 9:
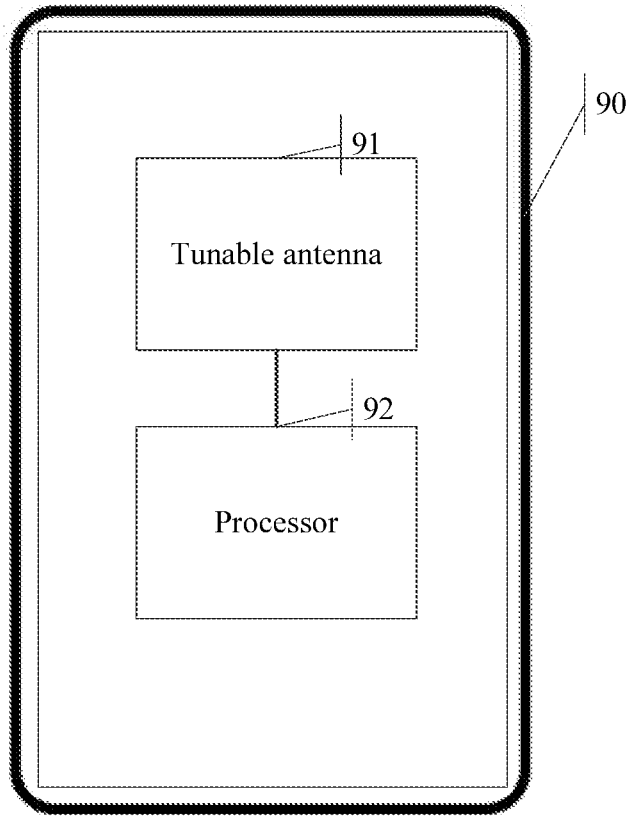
FIG. 9 is a structural diagram of a terminal according to an embodiment of the present disclosure.

Referring to FIG. 9, the terminal 90 includes a tunable antenna 91 and a processor 92, where the tunable antenna 91 includes a circuit board 10, an antenna body 11, configured to transmit and receive a signal of a first frequency band and including a feed end 11*a* and a ground pin 11*b*, where the feed end 11*a* is disposed on the circuit board 10, and an electrical tuning network 12, where a ground point 10*a* disposed on the circuit board 10 is connected to the ground pin 11*b* of the antenna body 11 by using the electrical tuning network 12, and the electrical tuning network 12 includes an inductor 12*a* and a first tunable capacitor 12*b* with a tunable capacitance value, where a load value of the inductor 12*a* is changed by tuning a first capacitance value of the first tunable capacitor 12*b* so that a first effective electrical length of the antenna body 11 is changed, where the processor 92 is configured to process transmitted and received signals of the tunable antenna 91.

In one embodiment, the inductor 12*a* is connected in series to the first tunable capacitor 12*b*, and then the load value is reduced by using the first tunable capacitor 12*b* so that the first effective electrical length is reduced.

In one embodiment, the inductor 12*a* is connected in parallel to the first tunable capacitor 12*b*, and then the load value is increased by using the first tunable capacitor 12*b* so that the first effective electrical length is increased.

In one embodiment, the first tunable capacitor 12*b* includes a first tunable sub-capacitor 12*b*-1 and a second tunable sub-capacitor 12*b*-2, where the first tunable sub-capacitor 12*b*-1 is connected in series to the inductor 12*a*, and the second tunable sub-capacitor 12*b*-2 is connected in parallel to the inductor 12*a*, where when the first tunable sub-capacitor 12*b*-1 operates properly and the second tunable sub-capacitor 12*b*-2 is open-circuited, the load value is reduced by using the first tunable sub-capacitor 12*b*-1 so that the first effective electrical length is reduced, when the first tunable sub-capacitor 12*b*-1 is short-circuited and the second tunable sub-capacitor 12*b*-2 operates properly, the load value is increased by using the second tunable sub-capacitor 12*b*-2 so that the first effective electrical length is increased.

In one embodiment, that the electrical tuning network 12 is connected to the ground pin 11*b* on the antenna body 11 is that the electrical tuning network 12 is connected to a tail end of the ground pin 11*b* or connected to an area that is on the antenna body 11 and near the ground pin 11*b*.

In one embodiment, the tunable antenna further includes a parasitic antenna stub 13, disposed on the circuit board 10 and configured to excite a high-frequency mode of the first frequency band.

In one embodiment, the antenna body 11 is disposed at an edge of the circuit board 10.

In one embodiment, the parasitic antenna stub 13 is disposed at an edge of the circuit board 10 and near the feed end 11*a*.

In one embodiment, the tunable antenna further includes a second tunable capacitor 14, disposed at a tail end 13*a* of the parasitic antenna stub 13, where the first effective electrical length and a second effective electrical length of the parasitic antenna stub 13 are changed by tuning a second capacitance value of the second tunable capacitor 14.

Because the terminal described in the embodiments of the present disclosure is a terminal on which a tunable antenna described in the embodiments of the present disclosure is disposed, based on the tunable antenna described in the embodiments of the present disclosure, persons skilled in the art can learn a specific structure and a variation of the terminal described in the embodiments of the present disclosure, which therefore are not described herein again. Any terminal on which the tunable antenna described in the embodiments of the present disclosure is disposed shall fall within the protection scope that is contemplated by the embodiments of the present disclosure.

One or more technical solutions provided in this application have at least the following technical effects or advantages:

In the embodiments of the present disclosure, a tunable antenna is provided. The tunable antenna includes an antenna body and an electrical tuning network. A first effective electrical length of the antenna body can be tuned by using the electrical tuning network. By tuning the first effective electrical length, a frequency band range of the tunable antenna is changed. The electrical tuning network includes an inductor and a first tunable capacitor with a tunable capacitance value. A load value of the inductor can be changed by tuning the first tunable capacitor so that the first effective electrical length is changed.

Because frequency tuning can be performed by using the inductor together with the first tunable capacitor, a frequency band range that can be tuned by means of frequency tuning is increased.

Further, because a range of a first capacitance value of the first tunable capacitor is continuous, a frequency band obtained when the frequency band range of the tunable antenna is tuned in such a tuning manner is also continuous, and the obtained frequency band range is relatively wide.

Further, because the load value of the inductor is tuned by using the first tunable capacitor, the load value of the inductor can be tuned in a relatively wide range, and therefore the first effective electrical length can also be adjusted in a relatively wide range. That is, in contrast with the prior art, even if a length of the antenna body is less than a length of the antenna body in the prior art, the first electrical length of the tunable antenna can still reach an electrical length of the antenna in the prior art by using the first tunable capacitor together with the inductor. Therefore, in a same frequency band range, the tunable antenna in the embodiments of the present disclosure has a relatively small size.

Further, even if a tunable antenna applied to a mobile phone in the prior art is applied to a WAN card, an effective electrical length of an antenna of the WAN card is not reduced such that relatively good low-frequency performance is ensured.

Further, when frequency tuning is performed by using the first tunable capacitor and the inductor, an insertion loss is relatively low. In addition, compared with a switch, ports of the first tunable capacitor and the inductor better match impedance of the tunable antenna.

Although some preferred embodiments of the present disclosure have been described, persons skilled in the art can make changes and modifications to these embodiments once they learn the basic inventive concept. Therefore, the following claims are intended to be construed as to cover the preferred embodiments and all changes and modifications falling within the scope of the present disclosure.

Obviously, persons skilled in the art can make various modifications and variations to the embodiments of the present disclosure without departing from the spirit and scope of the embodiments of the present disclosure. The present disclosure is intended to cover these modifications and variations provided that they fall within the scope of protection defined by the following claims and their equivalent technologies.

What is claimed is:

1. A tunable loop antenna, comprising:

a circuit board;

an antenna body configured to transmit and receive a signal of a first frequency band, wherein the antenna body comprises a feed end and a ground pin, and wherein the feed end is disposed on the circuit board; and an electrical tuning network, wherein a ground point disposed on the circuit board is connected to the ground pin of the antenna body using the electrical tuning network, wherein the electrical tuning network comprises an inductor and a first tunable capacitor with a tunable capacitance value, wherein the inductor is connected in series to the first tunable capacitor, and wherein a load value of the inductor is reduced by tuning a first capacitance value of the first tunable capacitor such that a first effective electrical length of the antenna body is reduced.

2. The tunable loop antenna according to claim 1, wherein the electrical tuning network further comprises a second tunable capacitor connected in parallel to the inductor and the first tunable capacitor, wherein the tunable antenna is configured to open circuit the second tunable capacitor to reduce the load value using the first tunable capacitor such that the first effective electrical length is reduced when the second tunable capacitor is open-circuited, and wherein the tunable antenna is configured to short circuit the first tunable capacitor to increase the load value using the second tunable capacitor such that the first effective electrical length is increased when the first tunable capacitor is short-circuited.

3. The tunable loop antenna according to claim 1, wherein the electrical tuning network is connected to a tail end of the ground pin or connected to an area that is on the antenna body and near the ground pin.

4. The tunable loop antenna according to claim 1, wherein the tunable antenna further comprises a parasitic antenna stub disposed on the circuit board and configured to excite a high-frequency mode of the first frequency band.

5. The tunable loop antenna according to claim 1, wherein the antenna body is disposed at an edge of the circuit board.

6. The tunable loop antenna according to claim 4, wherein the parasitic antenna stub is disposed at an edge of the circuit board and near the feed end.

7. The tunable loop antenna according to claim 4, wherein the electrical tuning network, further comprises a second tunable capacitor disposed at a tail end of the parasitic antenna stub, and wherein the first effective electrical length and a second effective electrical length of the parasitic antenna stub are changed by tuning a second capacitance value of the second tunable capacitor.

8. A terminal, comprising:

a processor; and a tunable antenna coupled to the processor, wherein the tunable antenna comprises:

a circuit board;

an antenna body configured to transmit and receive a signal of a first frequency band, wherein the antenna body comprises a feed end and a ground pin, and wherein the teed end is disposed on the circuit board; and an electrical tuning network, wherein a ground point disposed on the circuit board is connected to the ground pin of the antenna body using the electrical tuning network, wherein the electrical tuning network comprises an inductor and a first tunable capacitor with a first tunable capacitance value, wherein the inductor is connected in series to the first tunable capacitor, wherein a load value of the inductor is changed by tuning the first capacitance value of the first tunable capacitor such that a first effective electrical length of the antenna body is reduced, and wherein the processor is configured to process transmitted and received signals of the tunable antenna.

9. The terminal according to claim 8, wherein the first electrical tuning network further comprises a second tunable capacitor connected in parallel to the inductor and the first tunable capacitor, wherein the tunable antenna is configured to open circuit the second tunable capacitor to reduce the load value using the first tunable capacitor such that the first effective electrical length is reduced when the second tunable capacitor is open-circuited, and wherein the tunable antenna is configured to short circuit the first tunable capacitor to increase the load value using the second tunable capacitor such that the first effective electrical length is increased when the first tunable capacitor is short-circuited.

10. The terminal according to claim 8, wherein the electrical tuning network is connected to a tail end of the ground pin or connected to an area that is on the antenna body and near the ground pin.

11. The terminal according to claim 8, wherein the tunable antenna further comprises a parasitic antenna stub disposed on the circuit board and configured to excite a high-frequency mode of the first frequency band.

12. The terminal according to claim 8, wherein the antenna body is disposed at an edge of the circuit board.

13. The terminal according to claim 11, wherein the parasitic antenna stub is disposed at an edge of the circuit board and near the feed end.

14. The terminal according to claim 11, wherein the tunable antenna further comprises a second tunable capacitor disposed at a tail end of the parasitic antenna stub, and wherein the first effective electrical length and a second effective electrical length of the parasitic antenna stub are changed by tuning a second capacitance value of the second tunable capacitor.

* * * * *